US006751821B1

(12) United States Patent
Han

(10) Patent No.: US 6,751,821 B1
(45) Date of Patent: Jun. 22, 2004

(54) PRESTRESSED CONCRETE GIRDER OF ADJUSTABLE LOAD BEARING CAPACITY FOR BRIDGE AND ADJUSTMENT METHOD FOR LOAD BEARING CAPACITY OF BRIDGE

(75) Inventor: Man-yop Han, Kyungki-do (KR)

(73) Assignee: Interconstec Co., Ltd., Seoul (KR)

( * ) Notice: Subject to any disclaimer, the term of this patent is extended or adjusted under 35 U.S.C. 154(b) by 0 days.

(21) Appl. No.: 10/018,285

(22) PCT Filed: May 10, 2000

(86) PCT No.: PCT/KR00/00442

§ 371 (c)(1),
(2), (4) Date: Nov. 9, 2001

(87) PCT Pub. No.: WO00/68508

PCT Pub. Date: Nov. 16, 2000

(30) Foreign Application Priority Data

May 10, 1999 (KR) ..... 1999-16595
May 9, 2000 (KR) ..... 2000-24634

(51) Int. Cl.[7] ..... E04C 5/08; E04G 23/00

(52) U.S. Cl. ..... 14/74.5; 14/77.1; 52/223.8; 52/291

(58) Field of Search ..... 52/223.8, 291; 14/74.5, 77.1

(56) References Cited

U.S. PATENT DOCUMENTS 2,856,644 A * 10/1958 Dunham ..... 52/223.12
2,859,504 A * 11/1958 Crowley ..... 264/228
3,398,498 A * 8/1968 Krauss ..... 52/691
4,574,545 A * 3/1986 Reigstad et al. ..... 52/223.6
5,044,139 A * 9/1991 Mills ..... 52/741.1
5,241,721 A * 9/1993 Muller ..... 14/22
5,471,812 A * 12/1995 Muller ..... 52/745.19
5,867,855 A * 2/1999 Kim ..... 14/77.1
6,065,257 A * 5/2000 Nacey et al. ..... 52/223.8
6,332,301 B1 * 12/2001 Goldzak ..... 52/729.2
6,345,403 B1 * 2/2002 Nagle ..... 14/77.1

FOREIGN PATENT DOCUMENTS

JP 10-60823 * 3/1998
KR 1999-62050 7/1999

* cited by examiner

*Primary Examiner*—Gary S. Hartmann
(74) *Attorney, Agent, or Firm*—Burns, Doane, Swecker & Mathis, L.L.P.

(57) ABSTRACT

A prestressed concrete girder having an adjustable load bearing capacity includes a concrete girder including an upper flange, and at least one non-attached steel wire installed in the upper flange of the girder and extending in a lengthwise direction of the girder. A method of adjusting a load bearing capacity of a bridge using a prestressed concrete girder having an adjustable load bearing capacity including non-attached steel wires capable of being cut at an upper flange is also disclosed.

9 Claims, 9 Drawing Sheets

PRESTRESSED CONCRETE GIRDER OF ADJUSTABLE LOAD BEARING CAPACITY FOR BRIDGE AND ADJUSTMENT METHOD FOR LOAD BEARING CAPACITY OF BRIDGE

TECHNICAL FIELD

The present invention relates to a girder for a bridge or for a construction use and a method of adjusting the load bearing capacity of a bridge using the same, and more particularly, to a prestressed concrete girder having an adjustable load bearing capacity so that the tension of a steel wire is adjusted as necessary, for example, the tension of a steel wire is decreased as the load increases during construction, or there is a need to compensate for sagging or cracking of the girder due to a long-term load after construction, and to a method of adjusting the load bearing capacity of the bridge using the above girder.

BACKGROUND ART

A prestressed concrete (PSC) girder for a bridge has been used over 40 years and is widely used for a bridge having a span of 50 m and less in many countries. Recently, the length of the girder gradually increases as the width of roads increases. Girders of 40 m and more up to 95 m have been recently developed and used in the U.S. and the use thereof gradually increases. Such girders having a long span often use high strength concrete or a bulb T-shape profile having a large sectional coefficient. With an increase of use of the long-span girder, the U.S. Federal Road Administration suggested six series of the same kind of a profile to be used for a span of 20–30 m. Also, in 1988, the Administration suggested three standard profiles for a long-span girder in cooperation with the U.S. Prestressed Concrete Academy. Thereafter, various profiles of applications of the above standards are developed and used by the respective state of the U.S. and many universities. Accordingly, although the number of bridges constructed in the U.S. generally decreases, portion of structures including bridges using the prestressed concrete girder has been gradually increased.

Also, al the girders installed above piers of a bridge wear out for a long time or weighty vehicles exceeding a designed weight pass over the bridge, mold is damaged and an excess of sagging is generated. Here, a bending tension crack is generated together. When the damage continues, since the bridge finally collapses, appropriate repair and/or reinforcement of the bridge is required.

The repair and reinforcement of the PSC bridge is performed in an external steel wire reinforcement method in which steel wires installed outside must be fixed in an appropriate method. However, since it is difficult to install a fixing apparatus at an end portion of the girder and the reliability of the load bearing capacity of the fixing apparatus is not guaranteed, other various methods are used but no perfect apparatus has not been developed yet. Thus, when a crack an/or sagging is generated in the PSC bridge, the repair and reinforcement thereof is difficult. It will be a very advantageous merit that a girder already includes an apparatus to easily adjust or increases a level of the load bearing capacity of a bridge as necessary to overcome the above problems.

Also, the weights of vehicles gradually increase with an increase of the traffic amount and the development of vehicle manufacturing technologies or overall industries. When the weights of vehicles increase, the specification which is a standard of design must be modified accordingly. The design standard is established or revised by the Ministry of Construction and Traffic and there was a very significant revision of the specification in 1982. In the revision, the grade of a bridge is classified into three levels and the designed weight of the $1^{st}$ level is adjusted to 43 tons from 32 tons while the designed weight of a second level bridge is 32 tons. Such revision of the specification necessarily entails a state of unbalanced load bearing capacity in which that of the existing bridges do not match one another. That is, roads on which 43 ton trucks can ride and roads on which the 43 ton trucks cannot ride are mingled so that the efficiency of a nationwide transportation network is severely damaged. Thus, it is requested to seek an economic reinforcement method to increase the load bearing capacity of the second level bridges, occupying over 50% of the nation, to the first level bridges to coordinate the load bearing capacity of these bridges.

The width of roads is generally increased as the number of lanes in a road increases. Accordingly, the development of a long-span bridge for construction of elevated roads or overpasses crossing such wide roads is currently performed. Also, a prepollex beam has been domestically developed, but manufacturing and carriage thereof is difficult because it is too long and the price thereof is very expensive compared to the existing PSC beams.

Also, it is a recent trend to use high strength concrete because the long-span girder is manufactured. Accordingly, due to the application of high tension, the amount of creeps generated is very large. As the creep increases, the girder sags more, which affects the vertical alignment of the overhead road. When the vertical alignment is deteriorated, an impact coefficient due to vehicles passing the road additionally increases. Thus, in the case of the high strength girder or long-span girder, after a long-term use thereof, a repair to compensate for sagging through an appropriate method will be needed.

FIG. 1 is a view showing the structure of a bridge according to a conventional technology.

As shown in FIG. 1, according to the conventional technology, a plurality of I-type girders 12 are installed over a pier 10 and an upper plate slave (not shown) is installed above the girder 12.

FIG. 2 is a sectional view showing the arrangement of steel wires in the girder according to the conventional technology.

As shown in the drawing, the section of the girder 20 which is an I-type girder is formed of a body portion 22, an upper flange 28 and a lower flange 24. Also, a tensioning member 26 which is a plurality of steel wires is installed in the lower portion of the body portion 22 and the lower flange lengthwise with respect to the girder 20. An upper plate of a bridge is installed above the upper flange 28 and the bottom surface of the lower flange 24 is supported by the pier 10.

In the case of the I-type girder 20 according to the conventional technology, after construction is completed, when sagging or crack is generated due to passing of vehicles, thus damaging the bridge, so that the bridge needs to be repaired or the designed passage load needs to be increased according to a revision of the specification, it is a problem that there is no appropriate economic way to reinforce the girder.

DISCLOSURE OF THE INVENTION

To solve the above problems, it is one object of the present invention that a prestressed concrete girder having an adjustable load bearing capacity by which when an excess of sagging or a crack is generated to a is bridge due to long-term deterioration or overload, the sagging of a girder and crack can be compensated for by releasing the tension of the steel wires provided to the upper flange step by step, or when there is a need to increase the load bearing capacity of the bridge without any particular damage to the bridge, the load bearing capacity of the bridge can be easily increased with no special equipments, and to a method of adjusting the load bearing capacity of a bridge using the same.

Also, it is another object of the present invention that a prestressed concrete girder having an adjustable load bearing capacity by which, during construction, the steel wires are released step by step according to an increase of load to reduce the height of a mold of the girder or increase the span, and to a method of adjusting the load bearing capacity of a bridge using the same.

To achieve the above objects, there is provided a prestressed concrete girder having an adjustable load bearing capacity in a bridge comprises at least one non-attached steel wire installed at an upper flange of the girder in a lengthwise direction of the girder, in which the heigh of the bridge is reduced, the span of the bridge is increased, or a long-term crack or sagging of the bridge is compensated for by adjusting tension of the steel wires when the bridge is under construction, or after laying of slab or completion of construction.

It is preferred in the present invention that the upper flange comprises a cut-away portion formed at a predetermined portion thereof and through which the steel wires pass, in which the cut-away portion is always exposed so that the steel wires can be cut as necessary after construction is completed, and in which the number of steel cores forming the steel wires exposed to the outside at the cut-away portion by cutting or releasing some of steel cores so that the tension of the steel wires can be adjusted.

Thus, according to the present technology, the tension of the girder can be adjusted so that the above problems can be solved.

BEST MODE FOR CARRYING OUT THE INVENTION

The structure of operation of the present invention will be described in detail with reference to FIGS. 3A through 7.

Figure 1:
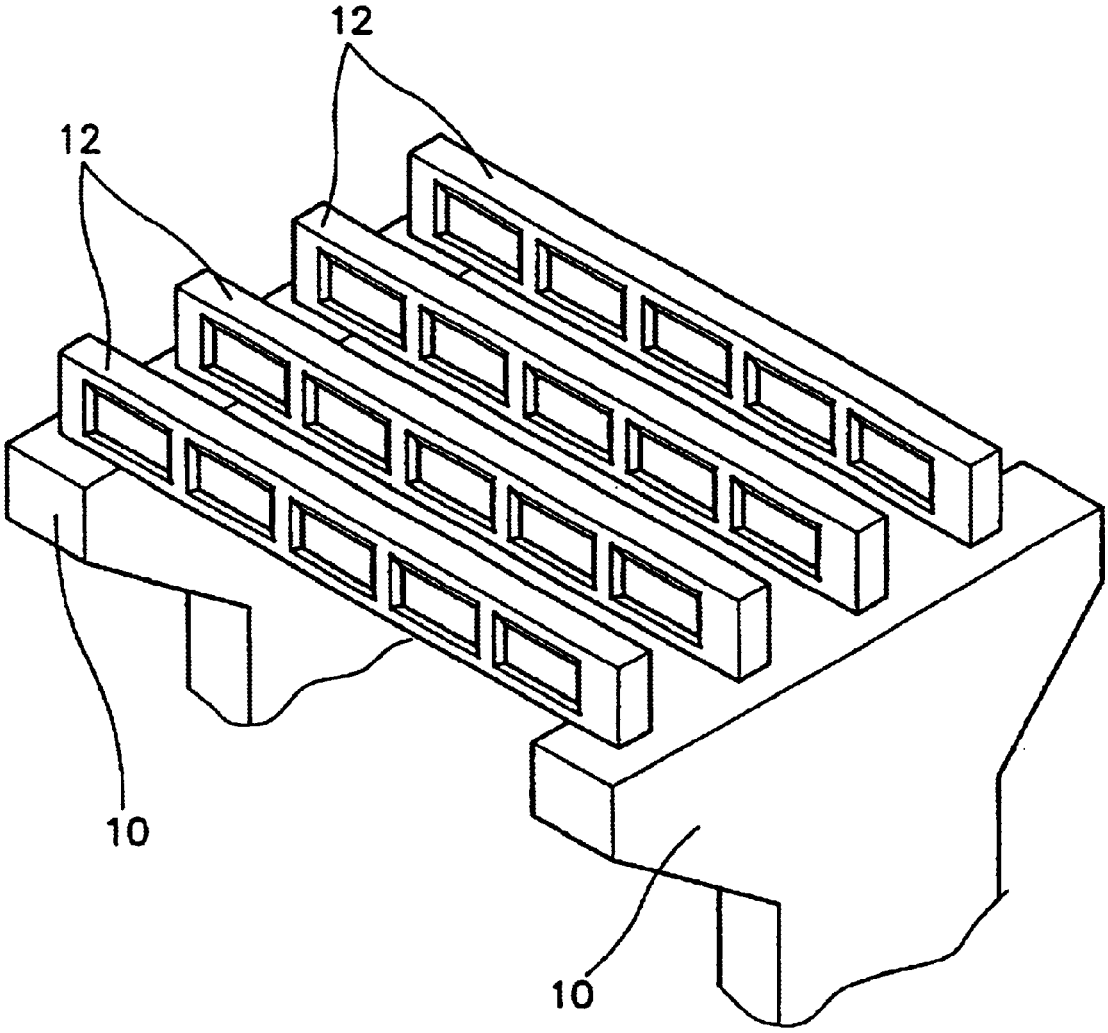
FIG. 1 PRIOR ART
FIG. 1 is a perspective view showing the structure of a bridge according to the conventional technology.
Figure 2:
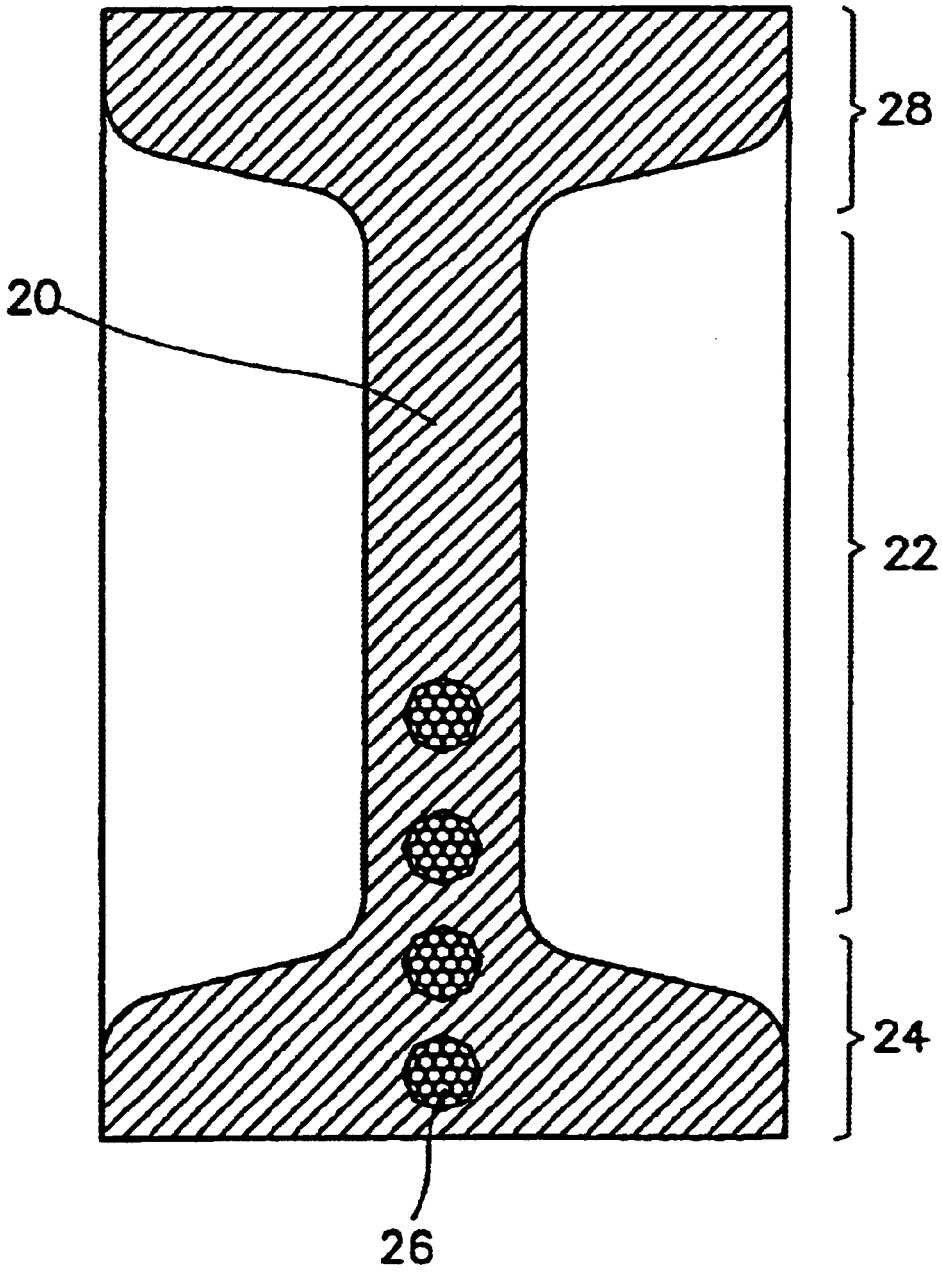
FIG. 2 PRIOR ART
FIG. 2 is a sectional view showing the arrangement of the steel wires in the girder according to the conventional technology.
Figure 3A:
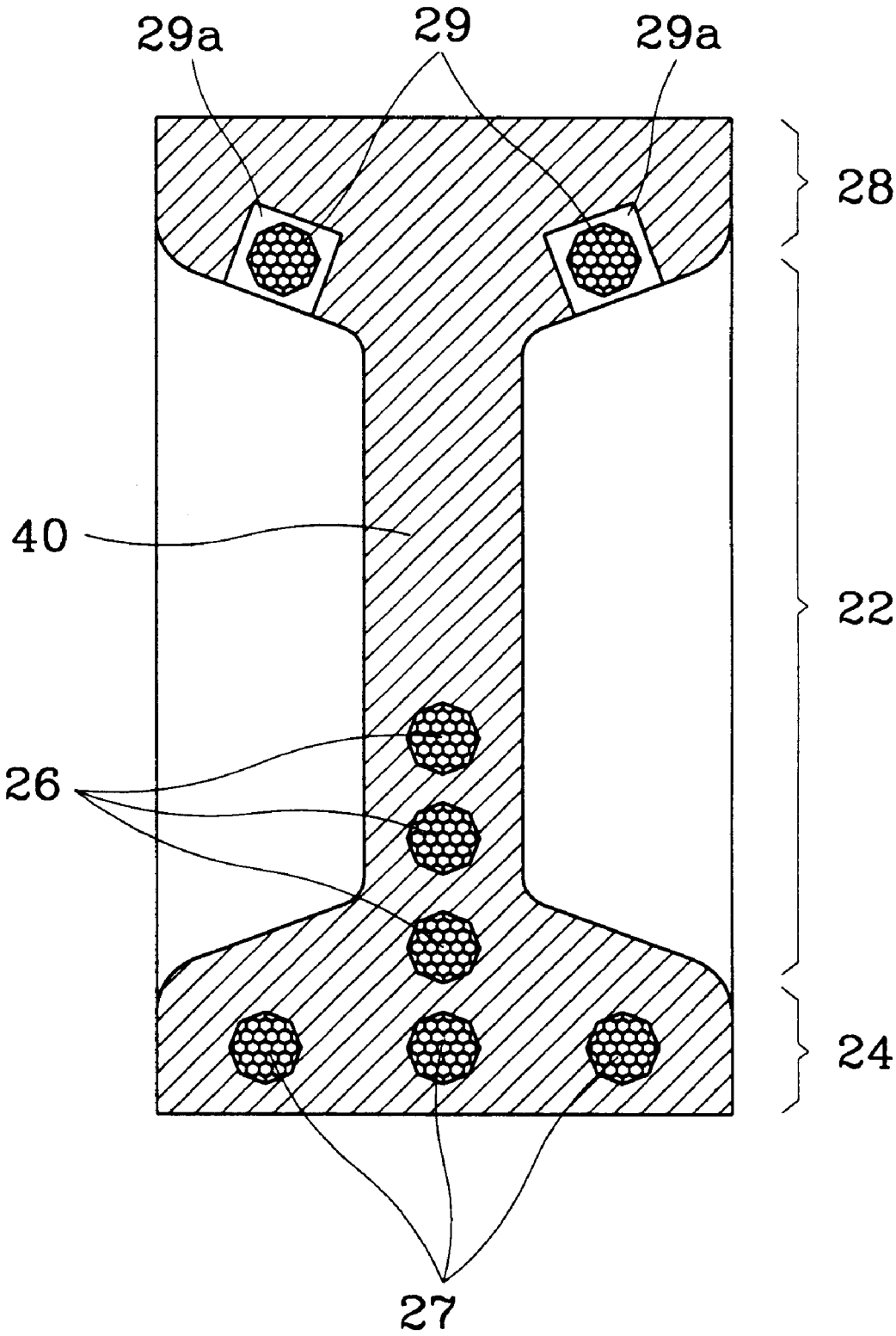
FIG. 3A is a sectional view showing the arrangement of steel wires in a central portion of a prestressed concrete girder having an adjustable load bearing capacity of a bridge according to a preferred embodiment of the present invention.

FIG. 3A is a sectional view showing the arrangement of steel wires in a central portion of a prestressed concrete girder having an adjustable load bearing capacity of a bridge according to a preferred embodiment of the present invention.

As shown in the drawing, the present invention includes an upper flange 28, a lower flange 24, and a body portion 22. Here, at least one steel wire 26 is installed in the girder 40 in a lengthwise direction of the girder 40 from a lower end of the body portion 22 of the girder 40 to the lower flange 24. Also, at least one steel wire 29 is provided in a space 29*a* formed in the upper flange in a lengthwise direction of the girder 40.

Also, the steel wire 29 is preferably installed so as not to be attached to the girder 40 to be symmetric at both sides of the upper flange 28. The upper flange 28 is provided latitudinally over the body portion 22 in view of the section of the girder 40. An upper plate of a bridge is installed above the upper flange 28. The lower flange 24 is provided latitudinally below the body portion 22 in view of the section of the girder 40. The bottom surface of the lower flange 24 is supported by a pier. A plurality of steel wires 26 which are attached to, or are not attached to the lower end of the lower flange 24 of the girder 40 are provided. Here, the steel wires 27 can adjust tension at the lower flange 24 of the girder 40.

Figure 3B:
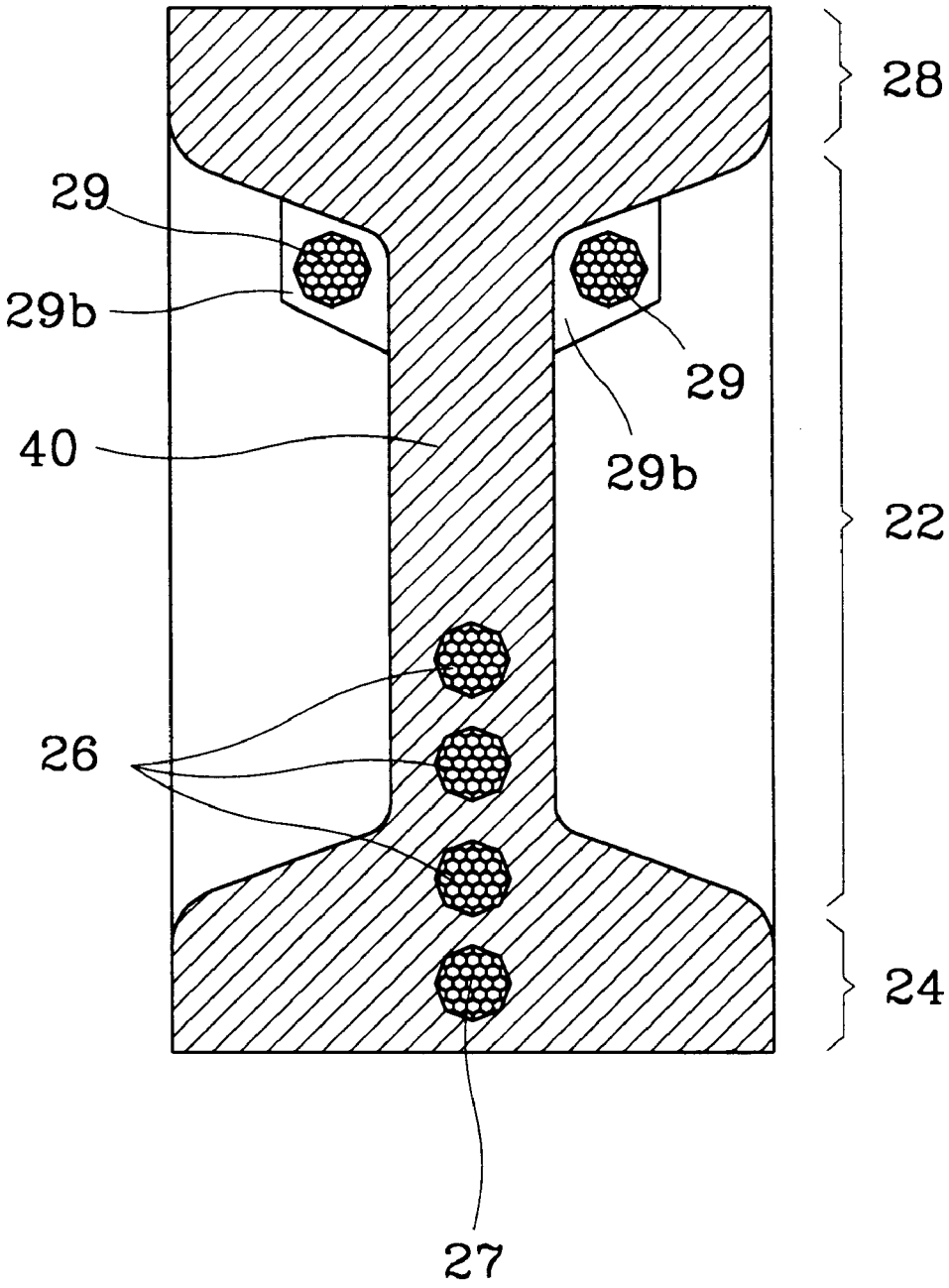
FIG. 3B is a sectional view showing the arrangement of steel wires according to another preferred embodiment of the present invention.

FIG. 3B shows steel wires of the girder according to another preferred embodiment of the present invention.

As shown in the drawing, the steel wire 29 which is not attached to the girder 40 can be provided in a space 29*b* formed between the upper flange 28 and the body portion 22.

Figure 4A:
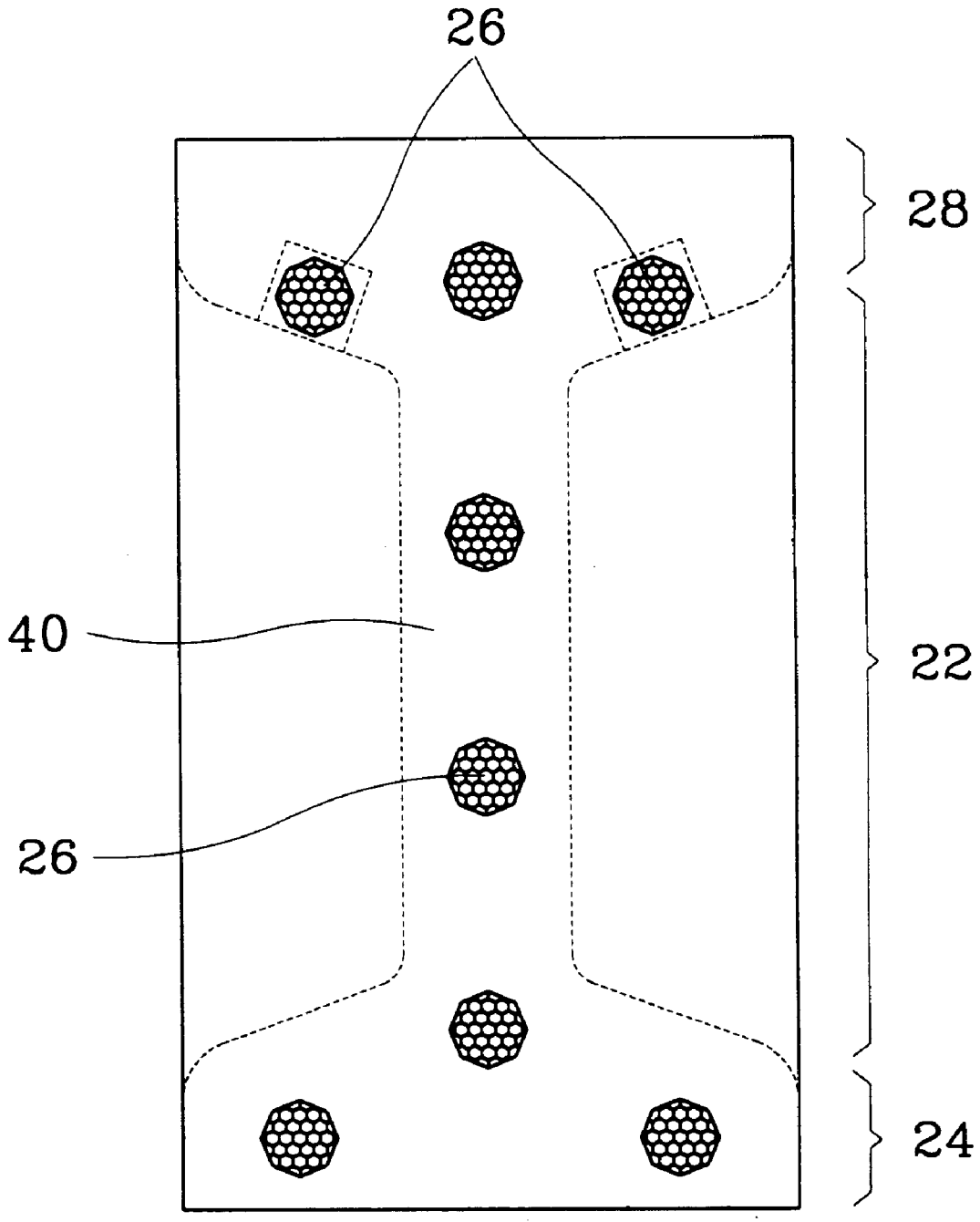
FIG. 4A is a sectional view showing the arrangement of the steel wires at one end portion of the girder according to the preferred embodiment of the present invention.

FIG. 4A is a sectional view showing the arrangement of the steel wires at the end portion of the girder according to the present invention.

As shown in the drawing, the steel wires 26 distributed between the central portion and the lower end of the body portion in FIG. 3A are arranged throughout the all sectional area of the girder 40. That is, the steel wire 29 installed at the upper flange 28 of the girder 40 is disposed at the place of the end portion of the girder, as shown in FIG. 4A, which means that these steel wires are linearly arranged throughout all the girder. Only when the steel wires additionally arranged at the upper and lower flanges 24 and 28 are distributed to be symmetric to the left to right, the tension by the steel wires can be distributed uniformly throughout all the sectional area at the end portion of the girder.

Figure 4B:
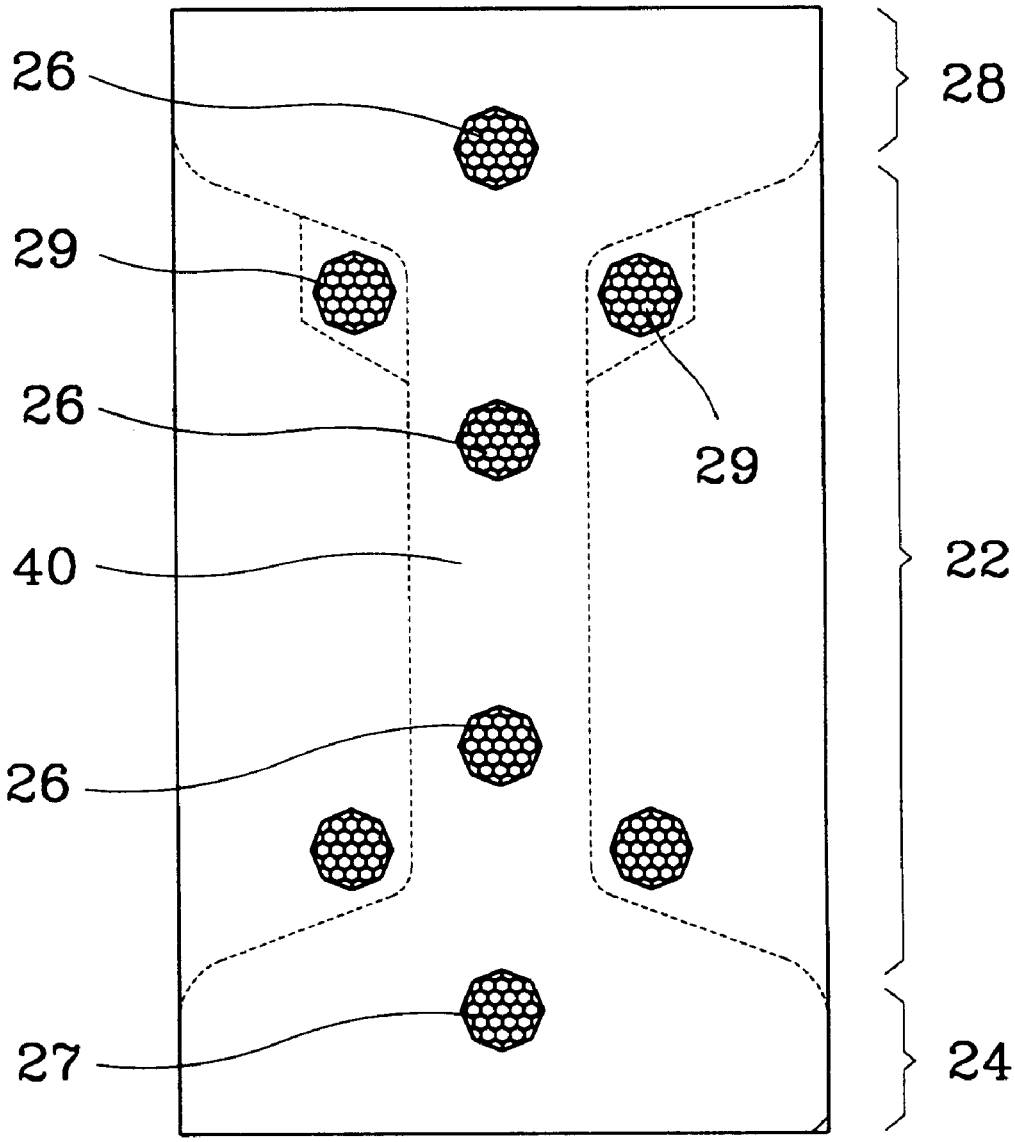
FIG. 4B is a sectional view showing the arrangement of the steel wires at one end portion of the girder according to FIG. 3B.

FIG. 4B shows the arrangement of the steel wires at the end portion of the girder shown in FIG. 3B.

As shown in the drawing, the steel wires 26 and 27 distributed between the central portion and the lower portion of the body portion of FIG. 3B are distributed throughout all the sectional area of the girder at the end portion thereof.

Figure 5:
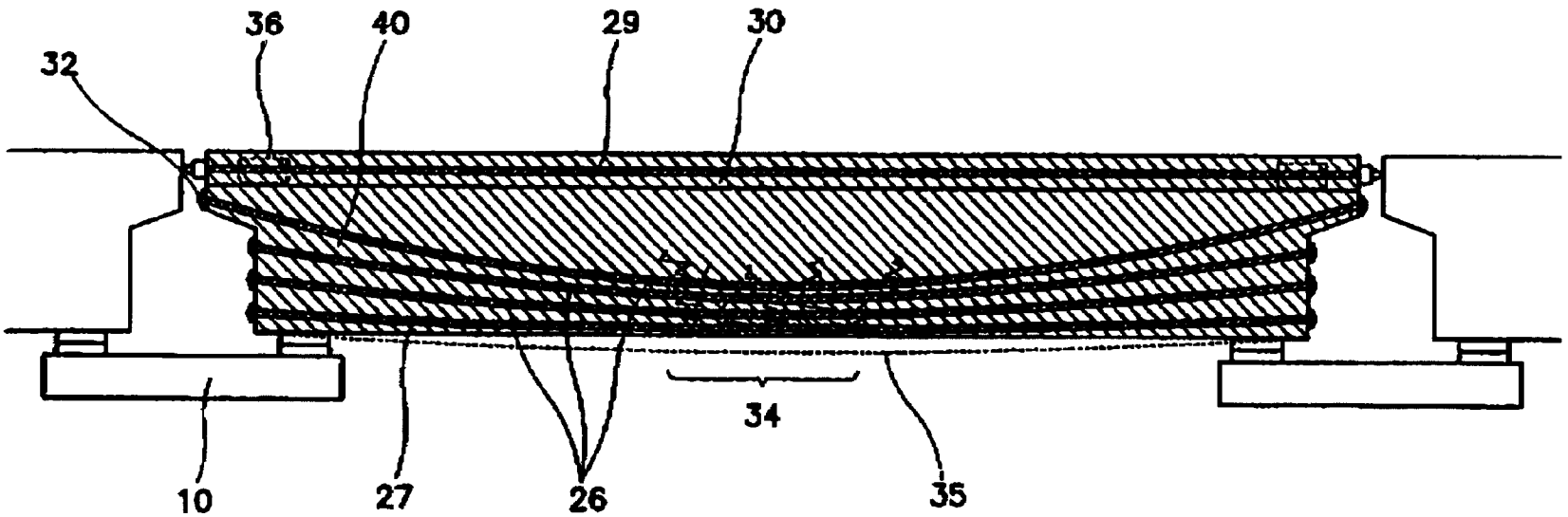
FIG. 5 is a view showing the lengthwise arrangement of the steel wires installed in the girder.

FIG. 5 shows the arrangement of the steel wires arranged lengthwise in the girder.

As shown in the drawing, the steel wires 26 and 27 arranged in the girder 40 have a parabolic shape such that they sag at the middle portion of the girder 40 while being uniformly distributed throughout tho entire sectional area at both end portions of the girder 40. The steel wires 26 and 27 which are tensioning members arranged as above are fixed by an anchoring apparatus 32 at either end of the girder. The anchoring apparatus 32 is covered by mortar or concrete after the girder is manufactured.

Also, the steel wire 27 disposed at the tower flange is fixedly attached to in the concrete. The tension of the steel wire 29 installed at the upper flange 28 is adjusted later. That is, the steel wire 29 provided at the upper flange 28 widens the interval between the girders to allow the anchoring apparatus to be capable of accessing so that the steel wires 29 can be relaxed later, or is exposed at a cut-away portion 36 formed at the predetermined position. The cut-away portion 36 provides a work space needed for relaxing the steel wire 29 later.

Figure 6:
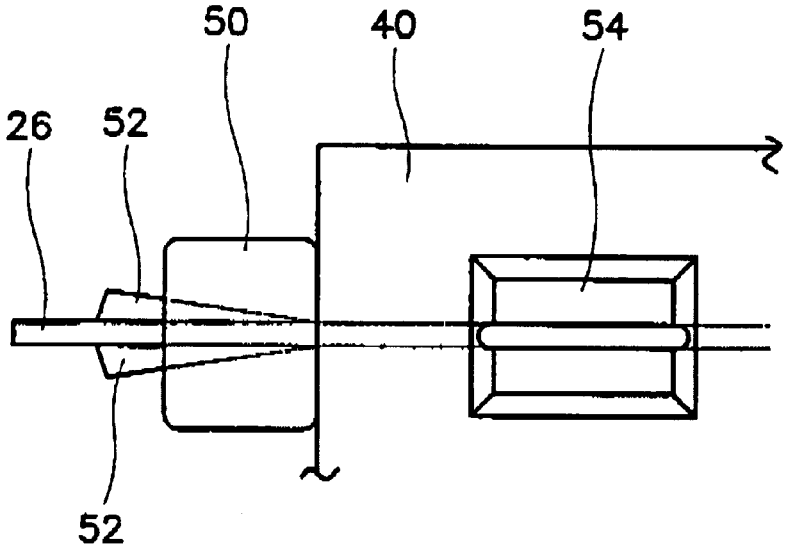
FIG. 6 is view showing that a fixed steel wire is exposed at a severed portion.

FIG. 6 is a view showing a state in which the fixed steel wire is exposed at a cut-away portion. For example, the steel wire 26 passing through a cut-away portion 54 is formed of many strands of steel cores. The number of the steel cores is adjusted by cutting some of the steel cores, so that the tension of the steel wire 26 is reduced step by step.

That is, when some steel cores forming the steel wire 26 are cut, the tension in the lengthwise direction of the girder 40 is reduced. Accordingly, since the tension in the lengthwise direction at the lower flange 24 forming a balanced state with the upper flange 28 increases, the lead bearing capacity of a bridge is improved. Since the steel cores forming the steel wire 26 which is exposed at the cut-away portion 54 are appropriately cut, the tension of the girder can be simply and rapidly released without an additional equipment such as a hydraulic jack.

Figure 7:
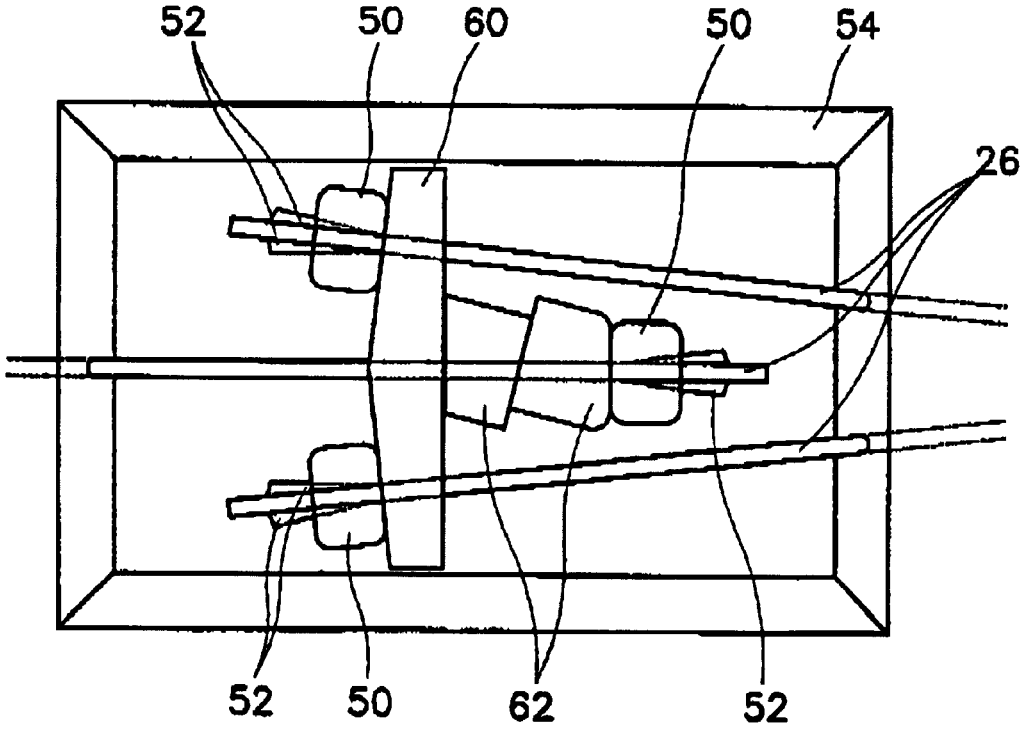
FIG. 7 is a view showing a preferred embodiment of anchoring of the steel wires.

FIG. 7 shows anchorage of the steel wire according to a preferred embodiment of the present invention.

As shown in the drawing, each of the steel wires 26 extending from ether end of the girder 40 and passing through a support member 50 is fixed by the support member 50 and a wedge 52. The tension is applied to the steel wires 26 in the state in which each of the steel wires 26 is fixed by the wedge 52. For example, the steel wires 26 are tightly tensioned by a force applied by the hydraulic jack, or the tension is controlled by adjusting a degree of deviation of adjustment wedges 62.

In the girder 40 according to the present invention, when the load increases step by step during construction of a bridge, or cracks 34 or sagging 35 indicated by a dotted line is generated to the bridge due to a long-term load after the construction of the bridge is completed, by cutting step by step some steel cores of the steel wires 29 formed of many steel cores at the upper flange of the girder 40, the tension of the girder is released so that the sagging of the girder 40 can be compensated for or the load bearing capacity of the bridge can be simply increased.

Or, the tension can be released by using the adjustment wedge or a similar method. Thus, the tension of the steel wires provided in the lower flange is affected by such relaxation so that the load bearing capacity of the girder can be increased.

Figure 8:
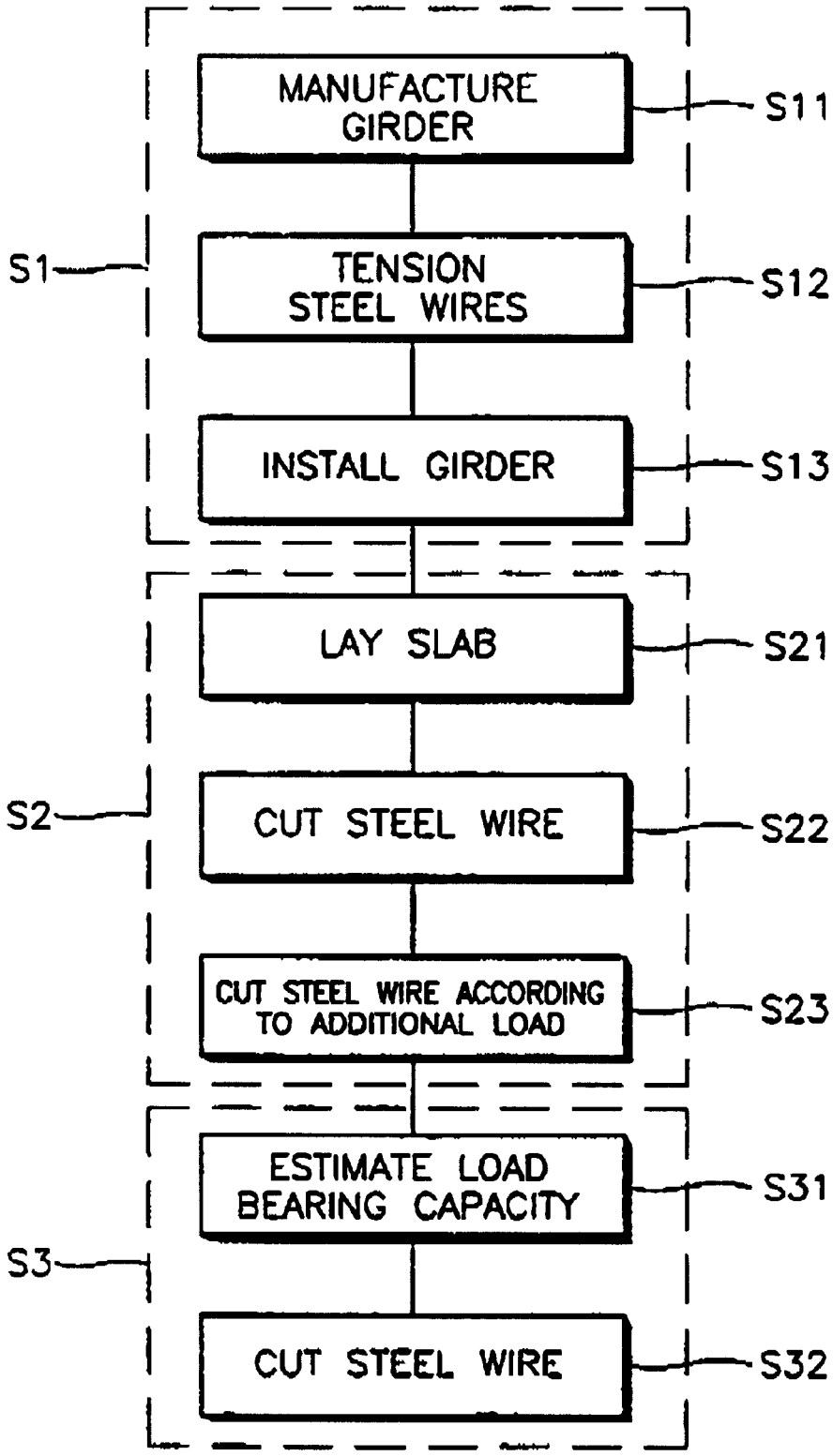
FIG. 8 is a flow chart for explaining a method of adjusting the load bearing capacity of a bridge using the prestressed concrete girder having an adjustable load bearing capacity according to the present invention.

A method of adjusting the load bearing capacity of a bridge using a prestressed concrete girder having an adjustable load bearing capacity, as shown in FIG. 8, includes steps of installing a prestressed concrete girder of the present invention over piers (S1), cutting step by step the non-attached steel wires according to the amount of load applied to the girder installed over the piers during construction of the bridge (S2), and cutting step by step the non-attached steel wires according to the amount of sagging of the girder while the bridge is in use after construction thereof (S3).

Here, the step (S1) of installing the girder over the piers consists of steps of manufacturing a girder (S11), tensioning the non-attached seel wires of the girder (S12), and installing the girder lifted by a crane between the neighboring piers and fixing it thereon (S13). That is, to prevent damage to the pier during carrying the girder to the pier, a non-attached steel wire for prevention of damage is auxiliary installed at the girder. Thus, when the girder is installed between the neighboring piers, the unnecessary non-attached steel wire for prevention of damage can be cut and removed.

Also, the step (S2) of cutting the non-attached steel wire during the construction of the bridge is provided to prevent possible damage or sagging of the girder generated as a compressing force or tension applied to the upper and lower portions of the girder deviates from an allowed value due to the load applied the girder when additional equipments such as upper plates, asphalt, guardrails, and illumination apparatuses are installed step by step above the girder installed over the piers. For example, slab is laid (S21), the non-attached steel wire is cut or released according to the weight of the slab (S22), and the weight of various additional equipments such as upper plates, asphalt, guardrails, and illumination of the bridge apparatuses is calculated and accordingly the non-attached steel wires corresponding to the number as many as the weight can be compensated for are cut step by step (S23). Thus, the height of the bridge can be lowered or the span of bridge can be increased.

Also, the step (S3) of cutting the non-attached steel wires step by step while the bridge is in use after construction thereof prevents damage to the girder due to deviation from allowance as a compression force and tension increases at the upper and lower portions of the girder when sagging is generated due to the fatigue load accumulated in the girder during the load of various vehicles passing over the bridge and repetition of impacts. The step (S3) includes steps of periodically estimating the amount of sagging of the girder or the load bearing capacity such as the compression force and tension acting on the upper and lower portions of the girder (S31), and cutting step by step as many as the non-attached steel wires enough to compensate therefor (S32).

Thus, since the compression force and tension acting on the girder which increases as time goes can be controlled to always be within a range of allowance, an excess of sagging or damage to the girder which can be generated during construction of the bridge can be prevented in advance.

It is noted that the present invention is not limited to the preferred embodiment described above, and it is apparent that variations and modifications by those skilled in the art can be effected within the spirit and scope of the present invention defined in the appended claims.

According to the present invention, by cutting or releasing step by step the steel wires installed in the upper flange of the girder of a bridge in which cracks or sagging is generated due to the long-term deterioration or creep or an excess of load to activate the tension of the lower flange, repair of the bridge is easy or the load bearing capacity of the bridge can be easily increased. Also, by manufacturing the girder so as to provide necessary tension during construction by appropriately releasing the tension of the steel wires, manufacturing a long-span bar or a low girder can be made easy.

Further, by releasing the tension of the girder later, sagging or cracks due to the long term use thereof can be easily compensated for. When the load bearing capacity of the girder needs to be increased, the repair thereof can be made easy. Also, the girder can be manufactured economically and the height of the girder is reduced.

Industrial Applicability

The prestressed concrete girder having an adjustable load bearing capacity of a bridge and a method of adjusting the load bearing capacity of the bridge can be applied to the design, construction and management of a bridge.

What is claimed is:

1. A prestressed concrete girder having an adjustable load bearing capacity comprising:

a concrete girder including an upper flange; and at least one non-attached steel wire installed in or immediately adjacent to the upper flange along at least a major portion of the girder and extending in a lengthwise direction of the girder.

2. The girder of claim 1, wherein said girder includes a central body portion and said upper flange extends laterally and symmetrically from both sides of said central body portion, and said at least one non-attached steel wire is disposed in a space formed between the upper flange and said central body portion along the entire length of said girder.

3. The girder of claim 2, wherein one of said at least one non-attached steel wire is disposed in a space formed between the upper flange and said central body portion along the entire length of said girder on each side of said central body portion.

4. The girder of claim 1, wherein at least one space is formed in the upper flange along the entire length of the upper flange, and each of said at least one non-attached steel wire is provided in one of said at least one space along the entire length of the upper flange.

5. The girder of claim 4, wherein said upper flange extends laterally and symmetrically from both sides of a central body portion of said girder, and one of said at least one space and said at least one non-attached steel wire is positioned in said upper flange on each side of said central body portion.

6. The girder of claim 5, wherein the upper flange includes a cut-away portion through which the at least one non-attached steel wire extends, and wherein a portion of the at least one non-attached steel wire disposed in the cut-away portion is always exposed so that the at least one non-attached steel wire can be cut.

7. The girder of claim 1, wherein the upper flange includes a cut-away portion through which the at least one non-attached steel wire extends, and wherein a portion of the at least one non-attached steel wire disposed in the cut-away portion is always exposed so that the at least one non-attached steel wire can be cut.

8. A method of adjusting a load bearing capacity of a bridge using a prestressed concrete girder having an adjustable load bearing capacity including non-attached steel wires capable of being cut and extending inside or immediately adjacent to an upper flange of said girder along the entire length of said upper flange, comprising:

installing the girder over a pier, cutting individual ones of the non-attached steel wires according to an amount of a load applied to the girder installed at the pier when the bridge is under construction; and cutting individual ones of the non-attached steel wires to obtain a desired amount of sagging of the girder after the construction is completed.

9. The method of claim 8, wherein:

said non-attached steel wires extending along said upper flange are prestressed to place an upper side of said girder in compression before installing the girder over the pier;

additional steel wires extending along a lower flange of said girder are prestressed to place a lower side of said girder in compression before installing the girder over the pier; and said cutting of said individual ones of the non-attached steel wires extending along said upper flange after said girder has been installed over the pier resulting in a reduction in the compression on the upper side of said girder and an increase in the compensating compression on the lower side of said girder.

* * * * *